United States Patent [19]

Sandmeier

[11] 4,215,492

[45] Aug. 5, 1980

[54] REMOVABLE INNER SOLE FOR FOOTWEAR

[76] Inventor: Arthur Sandmeier, 3 Av. de Lonay, 1110 Morges, Switzerland

[21] Appl. No.: 974,311

[22] Filed: Dec. 29, 1978

[30] Foreign Application Priority Data

Jan. 24, 1978 [CH] Switzerland ..... 1065/78

[51] Int. Cl.[2] ..... A43B 13/38; A43B 7/08; A43B 13/40

[52] U.S. Cl. ..... 36/44; 36/3 B

[58] Field of Search ..... 36/44, 43, 29.3 B, 3 R

[56] References Cited

U.S. PATENT DOCUMENTS

| | | | |
|---|---|---|---|
| 1,660,698 | 2/1928 | Williams, Sr. | 36/3 R |
| 1,809,323 | 6/1931 | Williams, Sr. | 36/3 R |
| 2,441,879 | 5/1948 | Gantt | 36/3 R |
| 2,442,026 | 5/1948 | Thompson, Jr. | 36/3 R |
| 2,474,815 | 7/1949 | Brahm | 36/3 R |
| 3,416,245 | 12/1968 | Ferreira | 36/44 |
| 3,475,836 | 11/1969 | Brahm | 36/3 B |
| 3,670,429 | 6/1972 | Androsiglio | 36/3 B |
| 3,716,930 | 2/1973 | Brahm | 36/3 B |
| 3,785,069 | 1/1974 | Brown | 36/44 |
| 3,791,051 | 2/1974 | Kamimura | 36/44 |

FOREIGN PATENT DOCUMENTS

| | | | |
|---|---|---|---|
| 181038 | 2/1907 | Fed. Rep. of Germany | 36/3 R |
| 860530 | 12/1952 | Fed. Rep. of Germany | 36/29 |
| 1685328 | 8/1971 | Fed. Rep. of Germany | 36/29 |
| 437051 | 11/1967 | Switzerland | 36/44 |
| 17228 | of 1906 | United Kingdom | 36/3 R |

*Primary Examiner*—James Kee Chi

*Attorney, Agent, or Firm*—Bauer & Amer

[57] ABSTRACT

A ventilating insole for use in a shoe in which the same includes an interior chamber for the forced flow of air unobstructed and uninterruptedly between the heel and toe portions thereof and through inlet and outlet openings.

11 Claims, 7 Drawing Figures

REMOVABLE INNER SOLE FOR FOOTWEAR

BACKGROUND OF THE INVENTION

The present invention relates to a removable inner sole for interposition between a foot and the interior foot-supporting surface of a shoe for ventilating the interior of the shoe and the foot with a constantly replenished supply of fresh air while gently massaging the foot to provide for greatly improved walking comfort.

It is well known that the inherently confining nature of a conventional shoe worn on and about the foot provides a restricted environment in which substantially trapped air stagnates and heats up, thereby facilitating the growth of disease-causing bacteria and the development of offensive odors. In such constricted, uncomfortably warm and stagnant surroundings the foot tires more quickly causing the wearer of the shoe unnecessary discomfort, occasional pain and often interfering with his plans or activities.

The prior art teaches a number of shoe constructions integrally incorporating pumping means for circulating a quantity of relatively fresh air about the foot and operable by the normal walking motion of the foot relative to and within the shoe. However, such constructions are for the most part unduly complex and generally restrictive upon the physical appearance of the shoe, as well as adding considerable weight and expense thereto.

Insertable ventilating insoles for use with conventional footwear are also disclosed in the art. Thus, U.S. Pat. No. 3,791,051 to Kamimura teaches an inner sole having separate pumping and discharge compartments and valve means for controlling air flow into the inner sole and between the compartments. Similarly, U.S. Pat. No. 3,716,930 to Brahm provides a three tiered arrangement of material layers defining an internally convoluted or tortuous path through which air is moved for forced ventilation of the foot.

Each of these insertable structures is characterized by relatively complex arrangements of elements that are costly to manufacture and consequently to the consumer. It will in addition be readily recognized that unless the internal structural features of such an insertable ventilating insole are kept to a bare minimum, the thickness of the same will be too great to permit a comfortable fit within an otherwise properly fitting shoe, and particularly at the toe-supporting or receiving end thereof where there is typically, and properly, little or no excess play between the foot and the upper of the shoe.

It is, therefore, the desideratum of the present invention to provide a ventilating insole insertable into and removable from a shoe for forcibly circulating a supply of fresh air about the foot as the user walks in the usual manner. In particular, it is an object of the invention to provide such an insole of advantageously simple construction having a minimum of component parts, and which insole will easily and comfortably fit within a properly fitting shoe.

Another object of the present invention is the provision of air discharge means at the toe portion of the insole such that fresh air is discharged from the insole substantially uniformly throughout and along the toe portion thereof.

It is a further object of the present invention to provide a removable insole which gently massages the foot during normal walking motion of the user.

Still another object of the invention is to provide an insertable insole which is extremely and beneficially inexpensive to fabricate utilizing well-known materials and methods.

These and other objects of the present invention are attained in an insole construction comprising a pair of resiliently deformable members shaped peripherally to fit within a shoe and secured together along their marginal edges. The members bound a single unobstructed chamber which extends for the full length and width thereof and further include spacer means enlarging the chamber at the heel portion to permit the accumulation in the enlarged heel portion of a quantity of fresh air from without the envelope through an air inlet opening. Discharge openings are provided at the toe portion of the envelope, where there are further included dimples or protrusions provided for the purpose of gently massaging the foot as the same is supported on the insole.

The above brief description, as well as further objects, features and advantages of the present invention, will be more fully appreciated by reference to the following detailed description of a presently preferred, but nonetheless illustrative, embodiment in accordance with the present invention when taken in conjunction with the accompanying drawings, wherein.

DETAILED DESCRIPTION OF THE PREFERRED EMBODIMENT

The present invention is directed toward an inner sole or insole insertable into and removable from an article of footwear, such as a shoe, for automatically forcing or circulating fresh air about a foot positioned therein as the wearer or user walks in a conventional manner so as to prevent the accumulation of hot, stale air in the confined areas about the foot and thereby inhibit the growth of odor-causing bacteria and the like. The ventilating insole of the invention further includes structural features which provide gentle massaging action to at least a portion of the foot and provides an air-cushioned foot-supporting surface within the shoe to promote increased foot comfort.

Figure 1:
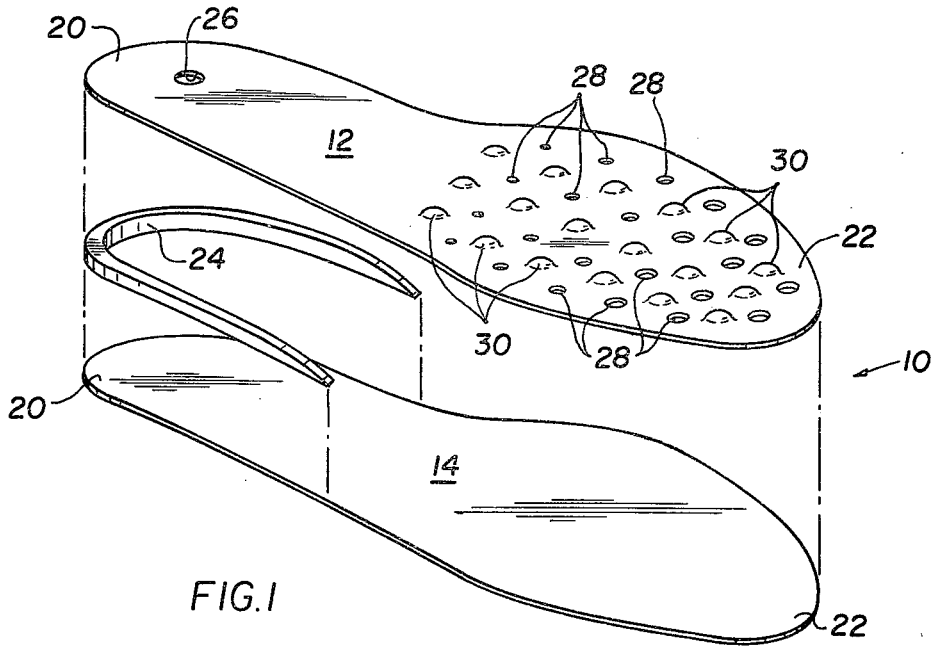
FIG. 1 is an exploded perspective view of a ventilating insole constructed in accordance with the present invention.
Figure 2:
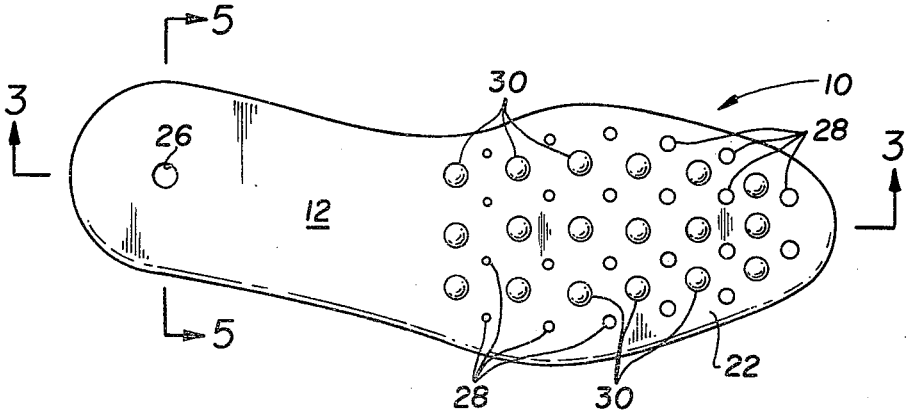
FIG. 2 is a plan view of the inventive ventilating insole.

A preferred embodiment of a ventilating insole constructed in accordance with the teachings of the present invention and demonstrating objects and advantages thereof is designated in the drawing by the general reference numeral 10. As best understood in conjunction with FIGS. 1 through 3, the insole 10 is of advantageously simple construction and comprises a pair of relatively flat, elongated sole parts or members 12, 14 formed of a self-supporting material and shaped peripherally to substantially conform in plan to and fit within a shoe. One or both of the members 12, 14 may be selectively contoured to conform to the sole of the foot.

The sole members 12, 14 are positioned in contiguous, overlaid relation and secured together along their marginal edges in any convenient manner to define an elongated envelope 16 bounding a single, unobstructed and continuous chamber 18 between the members 12, 14. The chamber 18 extends for substantially the full length and width of the overlaid members 12, 14 between the marginal edges thereof such that a fluid, such as air, within the chamber is normally permitted to freely pass within and throughout the full extent of the envelope 16 in an unrestricted manner.

It may at this point be noted that the longitudinally disposed opposite ends of the envelope 16 may be conveniently identified as the heel and toe portions or ends thereof and designated by the reference numerals 20, 22, respectively. As will be more fully understood as this description proceeds, these designations correspond to the orientation assumed by the ventilating insole 10 when the same is positioned for use within a shoe or other article of footwear. Thus, when the insole 10 is placed within a shoe, the heel portion 20 of the envelope 16 is positioned at or near the rear or heel end of the shoe and supportingly receives the heel of the foot thereon. In like manner, the toe portion 22 of the inventive insole 10 is interposed between the forward or toe end of the shoe's foot-supporting surface and the ball and toes of the foot. Analogously, the longitudinally forward and rear end portions of each of the sole parts or members 12, 14 may be referred to as, respectively, the toe and heel portions thereof and such description will be employed herein wherever convenient.

The upper member 12 is preferably formed with a slight arch or outwardly arcuate configuration so that when the members 12, 14 are secured together along their marginal edges, the upper member 12 bows outwardly from the lower member 14 and relative to the chamber 18. The outward arch or bow serves to normally maintain the members 12, 14 relatively spaced apart throughout the full extent of the chamber 18 so as to facilitate the free and unrestricted passage of air or other fluid in and through the same. If so desired, the lower member 14 may be similarly outwardly arched to increase the peripherally inward separation of the sole parts or members 12, 14.

A substantially U-shaped spacer 24 is connectingly interposed between the sole members 12, 14 along the marginal edges of the heel portion 20 to increase the separation or relative spacing between the overlaid members and thereby enlarge the chamber 18 at the heel portion. The spacer 24 is seen to substantially conform to the marginal configuration of the members 12, 14 so as to lie flush with the outer edges thereof and is formed as a curved rib extending only briefly into the interior of the envelope 16. The enlargement of the heel portion or end of the envelope 16 permits the accumulation of a quantity of air in this enlarged rear chamber portion, which accumulated air may subsequently be forced or moved through the chamber 16 toward the toe or forward end 22 as will soon be described.

Each of the members 12, 14 is formed of a resiliently deformable air-impervious material having the ability to undergo repeated deformations and subsequent returns to the original, undistorted configuration without material fatigue. Plastics formulated to exhibit the desired properties of flexibility and resilience while having sufficient rigidity to remain self-supporting provide a particularly convenient and advantageous construction material for the members 12, 14 in view of their ready adaptability for heat sealing, substantial freedom from chemical attack and other types of reactions in the usual operational environment of the invention, ease of availability and relatively low material and molding costs. Of course, any material adequately presenting the properties of flexibility and resilience in a selectively contoured, self-supporting construction may be utilized in forming the members 12, 14 and thus it is contemplated that certain synthetics, rubber or rubberized fabrics, for example, might be considered for use. The spacer 24 is preferably formed of a substantially non-deformable material—such as a suitable plastic or the like—although those skilled in the art will recognize that the use of a resiliently deformable spacer 24 is within the scope of the invention.

The molding of the members 12, 14 and of the spacer 24 in appropriately selected plastics advantageously permits the envelope 16 to be formed in a relatively simple series of heat-sealing operations. It is further anticipated that the envelope 16 could be molded in a single-piece construction wherein only certain marginal edge portions would require subsequent heat sealing or other means of securement to effect completion. Such manufacturing processes are well-known in the art and are considered to be outside of the teachings of the present invention.

The upper member or sole part 12 is provided with inlet means comprising at least an aperture defined at the heel end or portion thereof. In the execution of the invention seen in the drawing, a single, essentially circular aperture 26 is positioned at a substantially centrally-defined location of the heel portion of the member 12 to permit the entry of air into the envelope 16 and more particularly into the enlarged heel portion of the chamber 18.

Discharge means in the form of a plurality of openings individually and collectively designated 28 is similarly defined at the toe portion of the upper sole member 12. The number and precise locations of the openings 28 are not critical although the discharge openings are preferably provided throughout at least the full longitudinal extent of the toe portion 22 which may be considered as extending forward from the portion of the member 12 normally supporting the ball of the foot. As perhaps best seen in FIG. 2, the openings 28 are of increasing size or cross-sectional area as one moves longitudinally forward along the member 12. In other words, the distribution of the discharge openings 28 along the toe end of the member 12 is such that the size of each opening 28 at the rearwardly-disposed end of the toe portion is less than the size of each of the openings 28 at the forwardly-disposed end of the toe portion. As will be more clearly understand hereinafter, this distribution is provided to facilitate a substantially uniform discharge of air from within the envelope 16 along and throughout the full extent of the toe portion 22 of the inventive insole 10.

Figure 7:
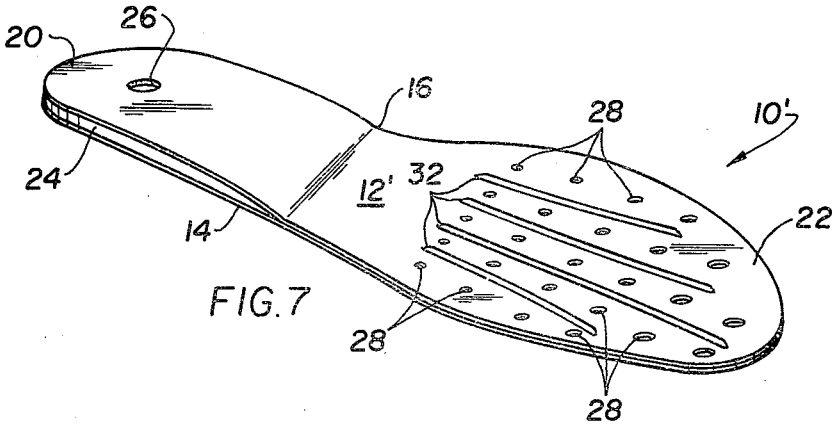
FIG. 7 is a perspective view of an alternative embodiment of the ventilating insole.

A plurality of protrusions 30 resembling outwardly projecting dimples are integrally formed on the upper member 12 such that the protrusions or dimples 30 are interspersed among and between adjacent ones of the discharge openings 28 at the toe portion of the envelope 16. The precise shape and size of the protrusions 30 are unimportant and accordingly such protrusions may, by way of example only, alternatively be provided in the form of upwardly raised elongated ribs designated 32 and seen in the construction of the alternative upper sole member 12' of FIG. 7. All other structural features and elements of the alternative sole member 12', and of the ventilating insole 10' of which the member 12' is a part, are identical with those of the upper sole part 12 and discussion of these corresponding features is, therefore, omitted. The ribs 32 are seen in FIG. 7 to extend substantially in the direction of the elongation of the member 12' at the toe end thereof and between adjacently disposed ones of the discharge openings 28.

Figure 4:
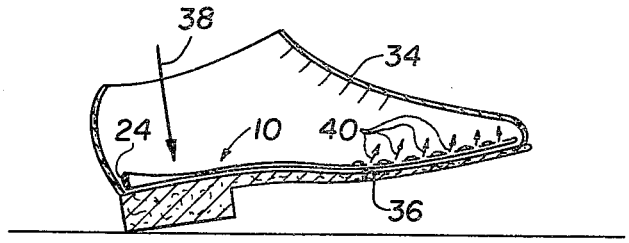
FIG. 4 is a side view of the ventilating insole operatively inserted within a shoe during the first phase of normal walking motion.
Figure 5:
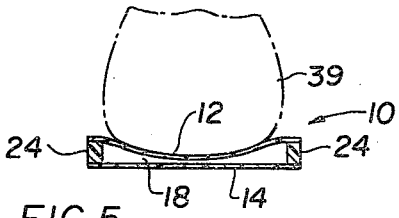
FIG. 5 is a view of the ventilating insole taken along the lines 5—5 in FIG. 2 and illustrating its cooperative relation with a foot during the first phase of normal walking motion.
Figure 6:
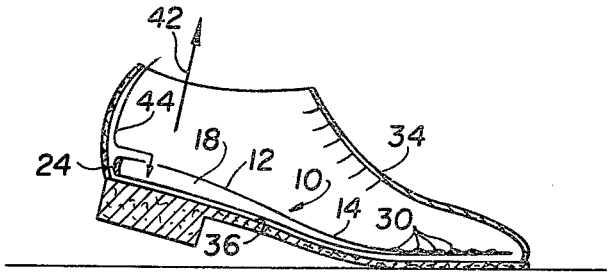
FIG. 6 is a side view of the ventilating insole operatively inserted within a shoe during the second phase of normal walking motion.

Operation and use of the ventilating sole 10 can best be understood by reference to FIGS. 4 through 6. The insole 10 is initially positioned within a conventional shoe 34 atop its normal foot-supporting interior surface or platform 36. Orientation of the insole 10 is effected such that the heel portion 20 of the envelope 16 overlays the heel of the shoe 34 while the toe portion 22 is disposed at the forward end of the shoe. The wearer's foot (not shown) is then inserted into the shoe in the normal manner so that the insole 10 is interpositioned between the interior shoe surface 36 and the bottom of the foot.

Figure 3:
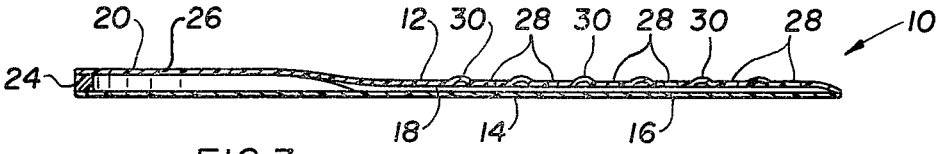
FIG. 3 is a view of the ventilating insole of FIG. 2 taken along the lines 3—3.

When initially placed in the shoe 34, the ventilating insole 10 is essentially in the expanded form of FIG. 3 wherein the peripherally connected sole members 12, 14 are fully separated or spaced apart inwardly of their marginal edges to delineate the chamber 18 and the enlarged heel portion thereof. The envelope 16 is automatically filled with air which is permitted to enter through the inlet aperture 26 as well as through the plural openings 28 normally utilized for discharge, as will soon be understood. Although initially essentially flat or planar as shown in FIG. 3, the construction material may be chosen so that the flexibility of the members 12, 14 permits the insole 10 to substantially conform to and assume the contours of the footsupporting surface 36 of the shoe 34.

As a person walks, each foot is repeatedly pivotted about the ankle so that the person's weight is first applied to the heel of the foot as a step is initially taken and the weight is thereafter shifted forward to the ball and toes of the foot as the other foot is brought or carried forward for the next step. Thus, the motion of each foot as a person walks can be examined in two readily identifiable phases, although the pivoting motion is in actuality essentially continuous.

The first part of the walking motion of a user of the inventive insole 10 is seen in FIG. 4. Here, in the initial phase of a step, the user's weight is applied to the heel portion of the shoe, and thus to the heel portion 20 of the envelope 16 interposed between the interior shoe platform 36 and the foot. The application of the downwardly-directed weight or pressure, as indicated by the reference arrow 38 in FIG. 4, has the effect of deforming the heel portion of the upper sole member 12 inwardly of its marginal edges and relative to the lower member 14 so as to compress and reduce the normally enlarged heel portion of the chamber 18.

Clearly, the air within the enlarged heel portion must be displaced by the compression of the area. The air is unable to escape through the inlet aperture 26 since, as understood, the downwardly-directed pressure of the heel against the member 12 produces sufficient sealing action to close the aperture 26, as shown in FIG. 5, even though the heel 39 may be covered with some type of porour material in the form of a sock. Consequently, the displaced air is forced longitudinally forward within and through the chamber 18 toward the toe portion 22 of the envelope from which it is able to escape through the outlet openings 28. The discharge is depicted by the reference arrows 40 in FIG. 4.

To provide an efficient ventilation, the discharge of air from the envelope should be effected along the full extent of the insole toe portion 22 so as to bathe the entire forward portion of the foot, from the ball to the toes thereof, in the discharged air. However, one might generally expect that the bulk of the displaced air would be discharged from the envelope 16 through those openings 28 first encountered as the air moves longitudinally forward along the chamber 18. Thus little, if any, air would finally reach the openings under the toes at the extreme forward end of the insole 10. The present invention overcomes this problem by providing that, as previously described, the size or cross-sectional area of the discharge openings 28 encountered by the internally forwardly moving air is increasingly greater as the air is forced further forward along the toe portion 22. That is to say, the relatively small size of the openings 28 first encountered permits only a small percentage of the displaced air to be discharged therethrough, while the next-encountered openings 28 are slightly larger for the discharge of some of the remaining air, and so on along the toe portion 22 of the envelope 16.

Accordingly, as downwardly-directed pressure from the heel of the foot is applied to the normally enlarged heel portion 20 of the envelope 16, the air in the enlarged area is pumped or forced longitudinally along the chamber 18 and substantially uniformly discharged through the plural openings 28 to bathe the forward portion of the foot in the discharged air. The effect of the second phase of the walking motion of the foot on the ventilating insole 10, as depicted in FIG. 6, will now be described.

As the foot is pivotted forward to shift the person's weight onto the ball and forward end of the foot, the pressure formerly applied to the heel portion 20 of the envelope 16 is relieved. This pressure relief is indicated by the reference arrow 42 in FIG. 6. The resilience of the sole parts or members 12, 14 causes the heel portion 20 of the envelope 16 to expand and reassume its normally-enlarged condition. Fresh air is permitted to enter the chamber 18 through the inlet aperture 26, in the manner illustrated by the reference arrow 44, by reason of the shift of the person's weight to the ball and forward end of the foot.

This weight shift from the heel to the forward portion of the foot is effective to momentarily lift the heel of the foot away from the inlet aperture 26 by an amount sufficient to permit air to pass through the aperture. Thus, the seal or closure shown in FIG. 5 is at least momentarily broken as the person's weight is shifted forward during the second phase of the normal walking motion. Fresh air is drawn into the insole 10 to fill the heel portion of the chamber 18, enabling the same to re-expand to its normally enlarged volume. The ventilating insole 10 is then in condition to again begin the pumping and aerating cycle commencing with the application of pressure to the heel portion 20 of the envelope 16.

It can, therefore, be appreciated that by the alternate relative deformation and release of the heel portions of the sole parts or members 12, 14 in the course of normal walking movement, the foot supported on the insole 10 is automatically and continuously ventilated and bathed in a constantly replenished supply of fresh air. In this manner, the accumulation of stagnant or stale air in the interior of the shoe and about the foot is prevented. The constantly repeated intake and discharge of fresh air causes corresponding displacement and change of the air about the confined foot so as to effectively cool and freshen the environment thereabout.

Further comfort is provided by the protrusions or dimples 30 (and correspondingly by the ribs 32 in the alternative embodiment of FIG. 7). The protrusions serve a dual function. In the first instance, they raise the forward portion of the foot away from the toe end 22 of the supporting member 12 so as to ensure that contact of the foot with the upper member 12 does not seal closed or otherwise substantially obstruct the discharge openings 28. Without provision of the dimples 30, it is possible that the discharge openings 28 could be undesirably closed and thereby prevent the ventilation of the foot. In such an instance, with no sufficient outlet for the air displaced from the compressed heel portion 20, a rupture of the envelope 16 could occur.

In addition, the dimples 30 contribute to a gentle and light massaging of the forward portion of the foot so as to increase the comfort of the walking user. Thus, as the person's weight is shifted forward onto the ball and toes of the foot in the course of each step, those forward portions of the foot are gently massaged as they contact the dimples 30. The result is significantly increased walking comfort permitting one to stay on his feet for longer periods of time without significant tiring or discomfort.

The size of the inlet aperture 26 should be at least, and preferably greater than, the total cross-sectional area of the plural discharge openings 28. This relationship is desired to assure that the filing of the enlarged heel portion of the chamber 18 as the members 12, 14 re-expand following compression is accomplished with sufficient speed to complete the full expansion before pressure is reapplied by the heel of the foot and with air entry effected entirely through the inlet aperture 26. If the aperture 26 is too small relative to the total cross-sectional size of the discharge openings and the volume of air to be moved therethrough, rapid walking motion could prevent full expansion of the chamber 18 between steps resulting in decreased operating efficiency of the insole 10 and curtailed ventilation of the foot.

There has herein been disclosed a preferred embodiment of a ventilating insole constructed in accordance with the present invention wherein alternate deformation and release of the flexibly resilient sole parts or members causes air to be pumped or forced forward from an enlarged heel portion for discharge at the toe end of the foot. In the particularly noteworthy and extremely simple construction disclosed, a single unrestricted and unobstructed chamber extending for substantially the full length and width of the inventive insole serves as a fresh air storage and pumping means, a forward conduction path and a discharge area without the use of complicating valving structures or the like. As a result, the profile of the inventive insole may be kept to a minimum so as to permit its use in virtually any article of footwear worn on the foot. Moreover, the inventive insole is thinnest at its forward or toe end where shoe interior space restrictions are greatest, and thickest at the rear or heel end where the ankle projects from the shoe opening and thus permits the accommodation of this additional thickness.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An inner sole insertable into and removable from a shoe for automatically ventilating the foot with fresh air during walking movement of the user, said inner sole comprising:

a pair of substantially flat elongated members formed of a resiliently deformable material and shaped peripherally to fit within a shoe;

said members being secured together along their marginal edges to define an elongated envelope bounding a single hollow unobstructed chamber between said members which extends continuously for substantially the full length and width thereof interior of said marginal edges to permit a free and unrestricted passage of air within and throughout said chamber, said envelope having a rearwardly-disposed heel portion and a forwardly-disposed toe portion at opposite ends along the elongation thereof;

means enlarging said chamber at said heel portion to enable the accumulation in said enlarged heel portion of a quantity of air movable therefrom toward said toe portion during walking movement of the user;

air inlet means comprising at least an aperture defined in one of said members at said heel portion through which air is admitted to said chamber;

and discharge means comprising a plurality of openings defined in said one member at said toe portion through which the air moved from said enlarged heel portion is discharged from said chamber for automatic ventilation of the foot during walking movement.

2. An inner sole according to claim 1, said heel enlarging means comprising spacer means disposed connectingly between said members along the marginal edges thereof at the heel portion of said envelope.

3. An inner sole according to claim 1, at least one of said members being provided with an arch when marginally secured to the other of said members such that said arched member bows outwardly from said other member and relative to said chamber so as to space apart said members along their entire extents interior of the marginal edges thereof and thereby facilitate a free and unrestricted passage of air within and throughout said chamber.

4. An inner sole according to claim 1, the total cross-sectional area of said inlet means being at least as great as the total cross-sectional area of said discharge means.

5. An inner sole according to claim 1, said plural discharge openings being distributed along the full longitudinal extent of said toe portion and said discharge openings being predeterminately sized such that said discharge openings progressively increase in size extending in a direction away from said heel portion so as to insure a substantially uniform discharge of fresh air through said plural discharge openings along the full longitudinal extent of said toe portion as the air is moved from said enlarged heel portion toward said toe portion through said chamber.

6. An inner sole according to claim 1, said inlet means being predeterminately defined in said heel portion such that as the foot of the user in the course of walking motion depresses said heel portion to compress the same and thereby move the air accumulated therein toward said toe portion the foot substantially closes said inlet means to prevent the escape of the fresh air in said chamber through said inlet means and force the air to move forward within said envelope for discharge through said plural discharge openings at said toe portion.

7. In an inner sole for interposition between a foot and the foot-supporting surface of a shoe, an elongated envelope formed of a deformably resilient material and bounding a single continuously hollow, unobstructed and unrestricted chamber extending substantially throughout the full length and width thereof, inlet means defined at one end of said envelope and communicating with said chamber for the admission of air into said envelope, and discharge means at an end of said envelope opposite said one end and communicating with said chamber for the discharge of air from said envelope, said discharge means comprising a plurality of selectively sized apertures distributed along said envelope from a central portion to said opposite end thereof, said distribution being such that the size of said apertures is smaller at said central portion than at said opposite end, whereby normal walking motion of the foot causes alternating compression and expansion of said one end of the envelope to automatically force the movement of air therein from said one end to said opposite end along said chamber for discharge through said discharge means and to refill said envelope with air through said inlet means, the selective sizing of said discharge apertures enabling a substantially uniform discharge of air along the full distribution of said apertures.

8. In an inner sole according to claim 7, dimple means outwardly protruding from said envelope at said opposite end and disposed between adjacent ones of at least some of said discharge apertures for sufficiently spacing the foot from said discharge apertures to prevent the closure of said apertures by the foot and for providing light massaging of the foot in the course of normal walking motion for increased foot comfort.

9. In an inner sole according to claim 8, non-deformable spacer means in said envelope at said one end to there enlarge said chamber so as to permit the maintenance of a greater quantity of air within said envelope for discharge therefrom at said opposite end.

10. In an inner sole, a pair of substantially flat elongated members shaped peripherally to fit within a shoe and having heel and toe portions defined at opposite ends along the elongation thereof, said members being formed on a self-supporting, deformably resilient material capable of deformation in response to pressure exerted thereon and said members each having a memory to automatically return the same to their initial undeformed condition upon removal of said exerted pressure, and heel spacer means for relatively spacing said members further apart at said heel portions than at said toe portions, said members being peripherally secured together and with said heel spacer means in overlaid relation with said heel spacer means peripherally interposed therebetween, one of said members being bowed upwardly away from the other of said members to assure the provision of a space between them so that said members define a continuous, uninterrupted and unobstructed passageway extending substantially along their full extents from said heel portions to said contiguous toe portions without obstruction or interruption therebetween.

11. In an inner sole according to claim 10, inlet means defined in the heel portion of said one member for the admission of air into said passageway, and discharge means at the toe portion of said one member for forced discharge of air from said passageway in response to relative deformation of said members resulting from the exertion of pressure thereon.

* * * * *

UNITED STATES PATENT AND TRADEMARK OFFICE

CERTIFICATE OF CORRECTION

PATENT NO. : 4,215,492

DATED : August 5, 1980

INVENTOR(S) : ARTHUR SANDMEIER

It is certified that error appears in the above-identified patent and that said Letters Patent are hereby corrected as shown below:

IN THE CLAIMS:

Claim 10, line 5, change "on" to --of--

Signed and Sealed this

*Fourth* Day of *November 1980*

[SEAL]

*Attest:*

SIDNEY A. DIAMOND

*Attesting Officer*

*Commissioner of Patents and Trademarks*